US009219334B2

(12) United States Patent
Sakai et al.

(10) Patent No.: US 9,219,334 B2
(45) Date of Patent: Dec. 22, 2015

(54) CONNECTION TERMINAL AND CONNECTOR PROVIDED THEREWITH

(71) Applicant: OMRON CORPORATION, Kyoto-shi (JP)

(72) Inventors: Takahiro Sakai, Moriyama (JP); Hirotada Teranishi, Osaka (JP)

(73) Assignee: OMRON CORPORATION, Kyoto-shi, Kyoto (JP)

( * ) Notice: Subject to any disclaimer, the term of this patent is extended or adjusted under 35 U.S.C. 154(b) by 87 days.

(21) Appl. No.: 13/949,840

(22) Filed: Jul. 24, 2013

(65) Prior Publication Data

US 2014/0038469 A1 Feb. 6, 2014

(30) Foreign Application Priority Data

Aug. 6, 2012 (JP) ..... 2012-174220

(51) Int. Cl.
*H01R 13/40* (2006.01)
*H01R 13/64* (2006.01)
*H01R 12/72* (2011.01)
(Continued)

(52) U.S. Cl.
CPC ..... *H01R 13/64* (2013.01); *H01R 12/727* (2013.01); *H01R 13/2428* (2013.01); *H01R 12/7064* (2013.01)

(58) Field of Classification Search
CPC ..... H01R 13/40; H01R 13/64; H01R 12/727; H01R 13/2428; H01R 12/7064
USPC ..... 439/733.1, 862, 500, 66, 74, 504, 759, 439/65, 591, 660, 630, 751, 858, 852, 861, 439/625, 884, 676, 742, 872
See application file for complete search history.

(56) References Cited

U.S. PATENT DOCUMENTS 6,022,248 A 2/2000 Wu et al.
7,357,665 B1 * 4/2008 Yan ..... 439/500
7,806,739 B2 * 10/2010 Hu et al. ..... 439/862
(Continued)

FOREIGN PATENT DOCUMENTS

JP 09-035797 A 2/1997
JP 2007157444 A 6/2007
(Continued)

OTHER PUBLICATIONS

Japanese Office Action issued Jul. 8, 2014 re: Japanese Application No. 2013-154843; citing: JP 2012-099267 A, JP 2007-157444 A and JP 2008-276987 A.
(Continued)

*Primary Examiner* — Abdullah Riyami
*Assistant Examiner* — Harshad Patel
(74) *Attorney, Agent, or Firm* — Shinjyu Global IP

(57) ABSTRACT

A connection terminal includes a movable contact portion protruding out of a contact hole of a housing of the connection terminal, and is adapted to be pressed; a first curved portion continuously formed, the first curved portion including a free end portion having a fixed portion; a second curved portion continuously formed, the second curved portion including a free end portion having the movable contact portion; a rigid coupling portion interposed between the first curved portion and the second curved portion, and an abutment portion disposed on an opposite side to the second curved portion with respect to the movable contact portion, and adapted to be displaced toward the rigid coupling portion.

19 Claims, 9 Drawing Sheets

(51) Int. Cl.
*H01R 13/24* (2006.01)
*H01R 12/70* (2011.01)

(56) References Cited

U.S. PATENT DOCUMENTS

| | | | | |
|---|---|---|---|---|
| 8,197,290 | B2 | 6/2012 | Koyama et al. | |
| 2009/0247004 | A1* | 10/2009 | Lou | 439/500 |
| 2011/0177726 | A1* | 7/2011 | Koyama et al. | 439/839 |
| 2012/0108111 | A1* | 5/2012 | Koyama et al. | 439/746 |
| 2012/0171905 | A1* | 7/2012 | Koyama et al. | 439/676 |
| 2014/0017946 | A1* | 1/2014 | Koyama et al. | 439/625 |

FOREIGN PATENT DOCUMENTS

| | | | |
|---|---|---|---|
| JP | 2008276987 | A | 11/2008 |
| JP | 201299267 | A | 5/2012 |
| KR | 10-2012-0057557 | A1 | 6/2012 |

OTHER PUBLICATIONS

Korean Office Action issued May 22, 2014 and English Translation Thereof re: KR Application No. 10-2013-0087806; citing: KR 10-2012-0057557 and U.S. Pat. No. 6,022,248; pp. 8.

* cited by examiner

CONNECTION TERMINAL AND CONNECTOR PROVIDED THEREWITH

CROSS REFERENCE TO RELATED APPLICATION

This application claims benefit of priority to Japanese Patent Application No. 2012-174220, filed on Aug. 6, 2012 of which the full contents are herein incorporated by reference.

BACKGROUND OF THE INVENTION

The present invention relates to a connection terminal.

In accordance with a conventional connection terminal as disclosed in Japanese Unexamined Patent Publication No. 9-35797, consists of a tamper-resistant contact wherein a contact composed of a conductor including a contact portion protruding into a bridge shape from a casing made of an insulating material, a cap member closing a space between the casing and the contact portion is provided on the contact.

As illustrated in FIG. 3 of Japanese Unexamined Patent Publication No. 9-35797, the contact disclosed therein is formed by bending one long conductive plate. Therefore, this makes it difficult to adjust displacement amount of a contact portion in the connector which includes plural curved portions. Further, due to this configuration a contact position is hard to be controlled. As a result, there is a problem that the contact portion 3 collide with a base 4 to easily generate a plastic deformation.

SUMMARY OF THE INVENTION

Accordingly, the invention provides a contact terminal which overcomes the above-mentioned problems and limitations of conventional art. Further, the invention provides a connection terminal in which the displacement amount of a movable contact portion is easily designed, particularly a connection terminal in which the plastic deformation caused by a collision of the movable contact portion due to an overload can be prevented, and a connector provided with the connection terminal.

In accordance with one aspect of the present invention, there is provided a connection terminal comprising: a movable contact portion protruding out of a contact hole a housing of the connection terminal, and adapted to be pressed; a first curved portion continuously formed, the first curved portion comprising a free end portion having a fixed portion; a second curved portion continuously formed, the second curved portion comprising a free end portion having the movable contact portion; a rigid coupling portion interposed between the first curved portion and the second curved portion; and an abutment portion disposed on an opposite side to the second curved portion with respect to the movable contact portion, and adapted to be displaced toward the rigid coupling portion.

Preferably, the rigid coupling portion is a coupling portion that has rigidity larger than those of the first curved portion and the second curved portion. Further, the rigid coupling portion can be realized by increasing a spring constant of a coupling portion between the first curved portion and the second curved portion as compared with spring constants of the first curved portion and the second curved portion.

In accordance with one of the preferred embodiments of the present invention, the first curved portion and the second curved portion may be formed by a plurality of curved extending portions, and a curved slit may be provided between the curved extending portions.

In accordance with another embodiment of the present invention, the abutment portion is adapted to abut on the rigid coupling portion.

In accordance with still another embodiment of the present invention, an abutting protrusion that protrudes from an outward surface of the rigid coupling portion and is adapted to abut on the abutment portion.

In accordance with another aspect of the present invention, there is provided a connector has a configuration in which the movable contact portion of the connection terminal protrudes out of a contact hole of a housing of the connection terminal and is adapted to be pressed.

In accordance with yet another embodiment of the present invention, the housing comprises an inner peripheral edge portion and the edge portion having a positioning portion, such that the abutment portion abuts on the positioning portion.

BRIEF DESCRIPTION OF THE DRAWINGS

The invention will become more readily appreciated and understood from the following detailed description of preferred embodiments of the invention when taken in conjunction with the accompanying drawings, in which.

DETAILED DESCRIPTION

Figure 1A:
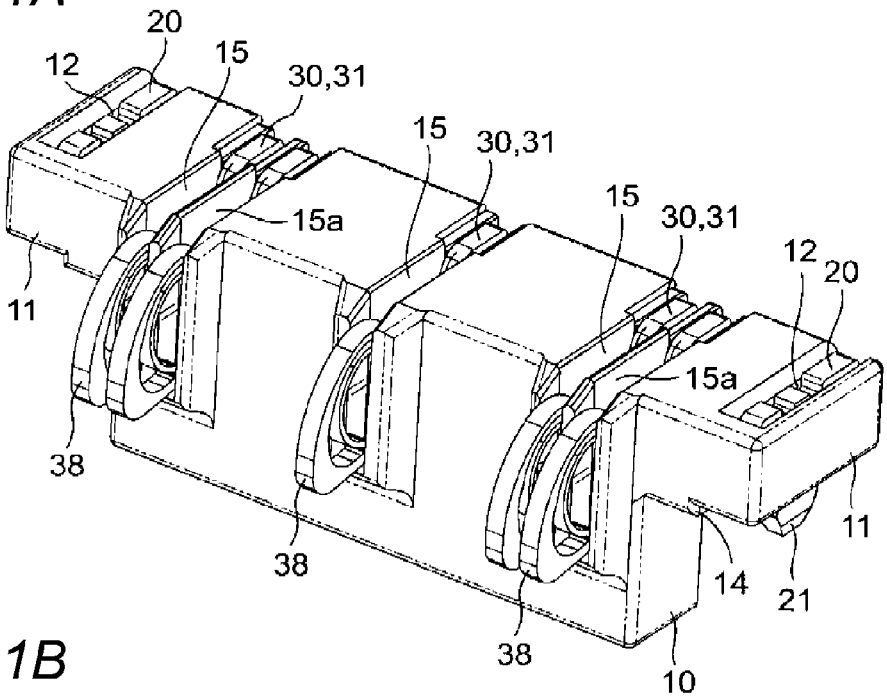
FIG. 1A is a perspective view illustrating a connector in which a connection terminal according to the first embodiment of the present invention is incorporated.
Figure 1B:
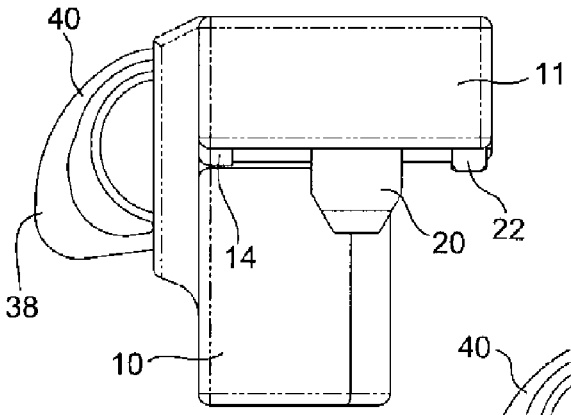
FIG. 1B is a right side view illustrating a connector in which a connection terminal according to the first embodiment of the present invention is incorporated.

The present invention is described hereinafter by various embodiments with reference to the accompanying drawings, wherein reference numerals used in the accompanying drawings correspond to the like elements throughout the description. Further, while discussing various embodiments, cross reference will made between the figures. In order to achieve full description and explanation, specific details have been mentioned to provide thorough and comprehensive understanding of various embodiments of the present invention. However, said embodiments may be utilized without such specific details and in various other ways broadly covered herein.

A connection terminal according to an exemplary embodiment of the present invention will be described below with reference to FIGS. 1 to 9.

As illustrated in FIGS. 1 to 6, a connector in accordance with the first embodiment of the present invention comprises of fixing metal fittings 20 which are press-fitted in both ends of a resin-molded housing 10, and connection terminals 30 which are press-fitted, at predetermined intervals, between the fixing metal fittings 20. Preferably, the housing 10 of the connector has outside dimensions of a height of 3.5 mm and a maximum depth of 2.8 mm, and the housing 10 is assembled in a printed board (not illustrated) by fitting the housing 10 in a substantial U-shape notch provided in an upper-surface edge portion of the printed board.

Figure 5A:
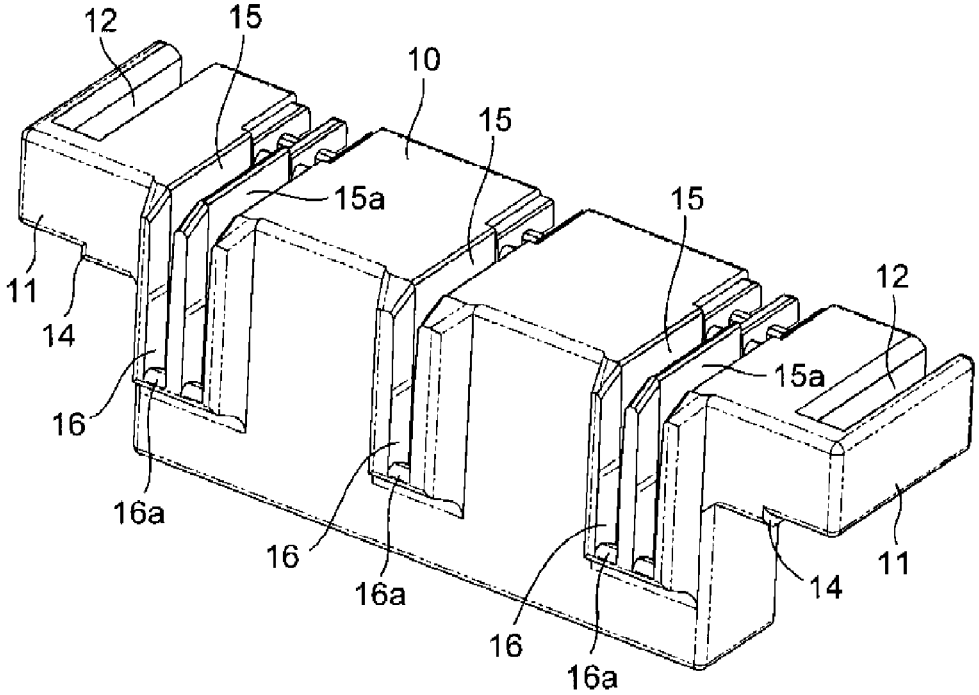
FIG. 5A is a perspective view of housing alone as shown in FIGS. 1A, 1B and 1C.
Figure 5B:
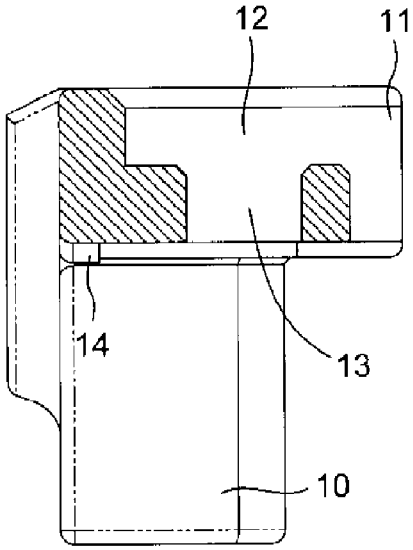
FIG. 5B is a partial sectional view of housing alone as shown in FIGS. 1A, 1B and 1C.
Figure 5C:
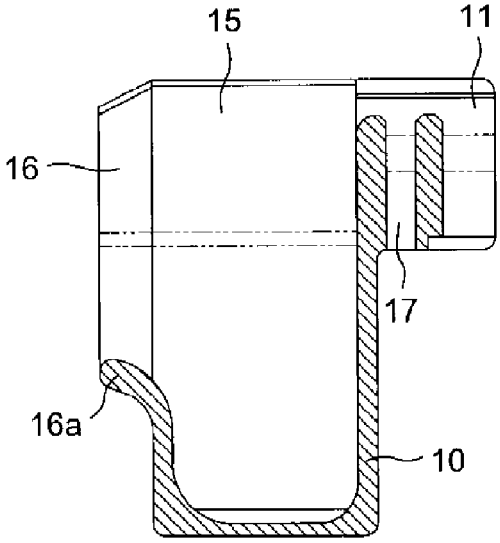
FIG. 5C is a central sectional view of housing alone as shown in FIGS. 1A, 1B and 1C.

As illustrated in FIGS. 5A, 5B and 5C, bulging-out portions 11 protrude laterally in the housing 10, and the bulging-out portions 11 are continuously provided along side surfaces and a rear surface of the housing 10. A first storage space 12 in which the fixing metal fitting 20 (to be described) can be press-fitted in from above is provided at each end of the bulging-out portion 11 (FIG. 5B). A press-fitting latch hole 13 is made along inside surfaces opposed to each other in the first storage space 12. A positioning protrusion 14 protrudes from a bottom base in the bulging-out portion 11.

In the housing 10, three of second storage spaces 15 are provided, in parallel, between the first storage spaces 12. Further, in each of the second storage spaces 15 the connection terminal 30 can be press-fitted from above. Particularly, the second storage space 15 provided in a position adjacent to the first storage space 12 which is partitioned by a partition wall 15*a*. As shown in FIG. 5C, in the housing 10, a contact hole 16 is made on a front surface side thereof and a lower inner peripheral edge portion of the contact hole 16 is used as a positioning portion 16*a*. Further, the contact hole 16 is communicated with the second storage space 15, and a movable contact portion 38 of the connection terminal 30 (to be described) can be inserted in and taken out from the contact hole 16. Also, a press-fitting latch hole 17 is made in the housing 10 and communicates with the second storage space 15.

Figure 1C:
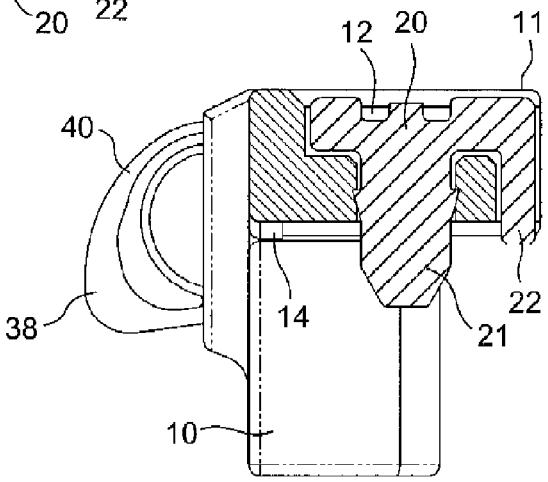
FIG. 1C is a partial sectional view illustrating a connector in which a connection terminal according to the first embodiment of the present invention is incorporated.
Figure 2A:
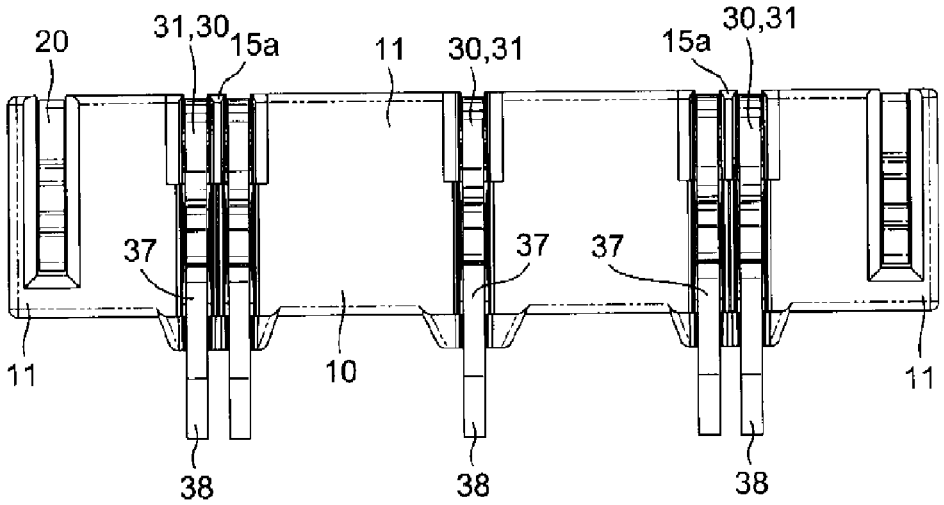
FIG. 2A is a plan view illustrating the connector, as shown in FIGS. 1A, 1B and 1C, in which the connection terminal of the first embodiment is incorporated.
Figure 2B:
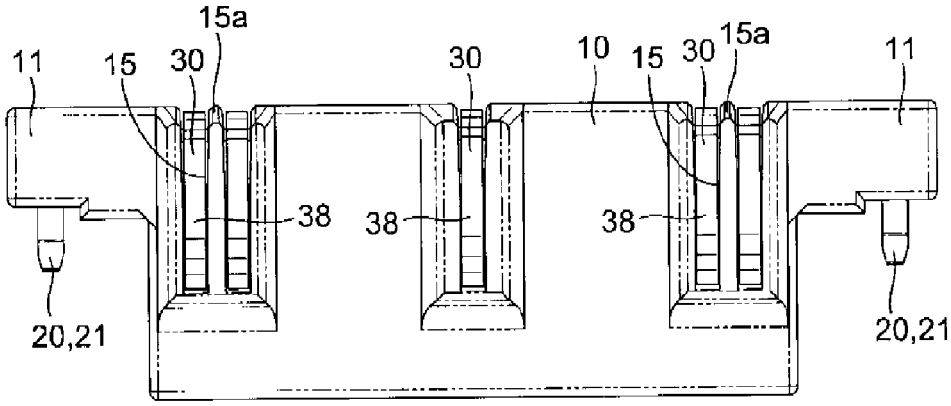
FIG. 2B is a front view illustrating the connector, as shown in FIGS. 1A, 1B and 1C, in which the connection terminal of the first embodiment is incorporated.
Figure 3A:
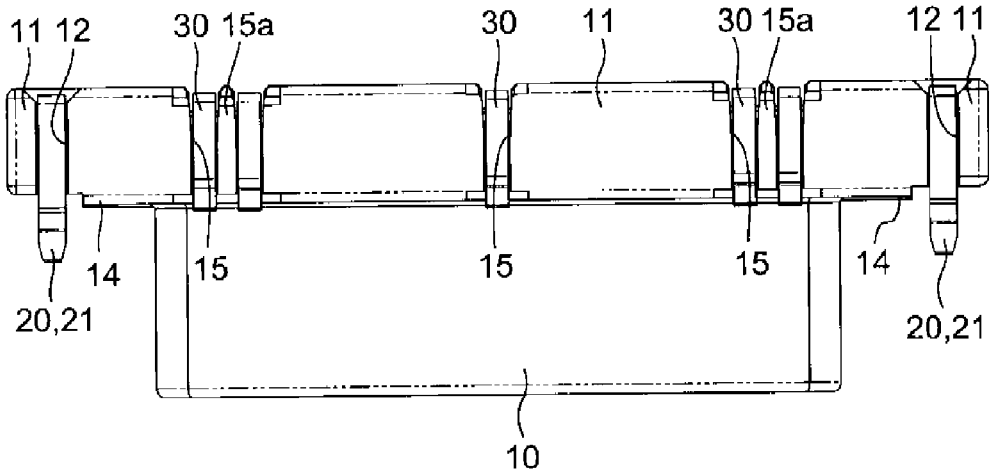
FIG. 3A is a rear view illustrating the connector, as shown in FIGS. 1A, 1B and 1C, in which the connection terminal of the first embodiment is incorporated.
Figure 3B:
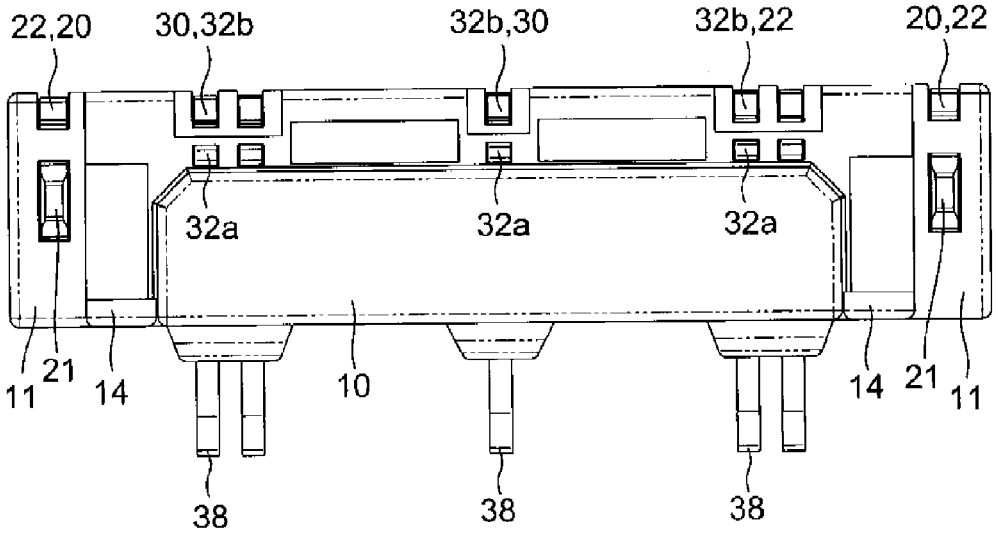
FIG. 3B is a bottom view illustrating the connector, as shown in FIGS. 1A, 1B and 1C, in which the connection terminal of the first embodiment is incorporated.

As illustrated in FIG. 1C, the fixing metal fitting 20 is a press-formed product that is formed by punching a metallic thin plate. Further, a latching pawl 21 and a positioning support 22 are provided in parallel within the fixing metal fitting 20. Therefore, the latching pawl 21 of the fixing metal fitting 20 is press-fitted from above in the press-fitting latch hole 13 of the first storage space 12 which is provided in the housing 10, whereby the fixing metal fitting 20 is retained and the positioning support 22 of the fixing metal fitting 20 is flush with a lower end face of the positioning protrusion 14 of the housing 10.

Figure 6A:
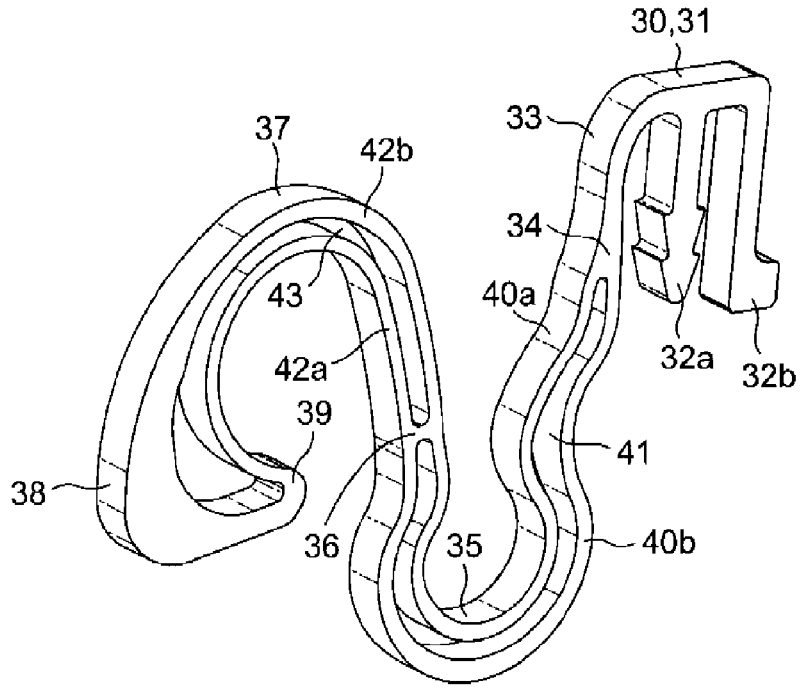
FIG. 6A is a perspective view illustrating the connection terminal of the first embodiment.
Figure 6B:
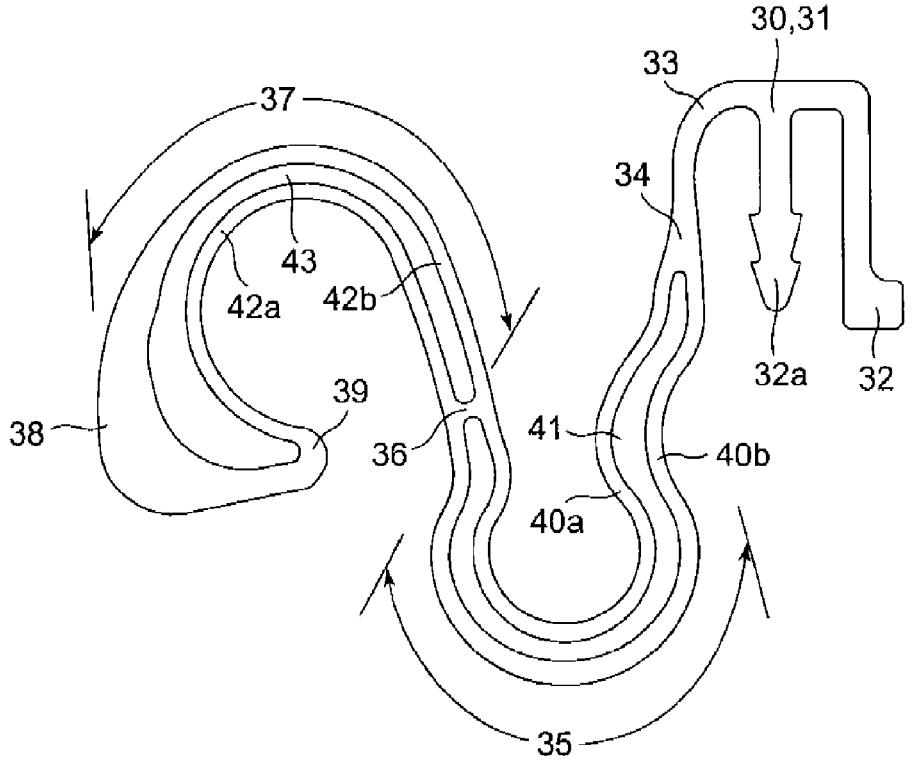
FIG. 6B is a front view illustrating the connection terminal of the first embodiment.

As illustrated in FIGS. 6A and 6B, in the connection terminal 30, a press-fitting latching pawl 32*a* protrudes downward from an intermediate position of a fixed portion 31, a support 33 extends downward from one end of the fixed portion 31, and a substantial L-shape terminal portion 32*b* extends downward from the other end of the fixed portion 31. A substantial U-shape first curved portion 35 extends from a branch portion 34 located at a leading end of the support 33, and a substantial U-shape second curved portion 37 in which an opening is disposed in the opposite direction to the first curved portion 35 extends from the first curved portion 35 where an abutment-receiving portion 36 of the rigid coupling portion is interposed therebetween. The first curved portion 35 and the second curved portion 37 are disposed into a substantial S-shape while continuously coupled to each other with the abutment-receiving portion 36 interposed therebetween. More specifically, openings of the curved portion 35 and the second curved portion 37 are oriented toward the opposite directions to each other with respect to a line segment connecting ends of the first curved portion 35 and the second curved portion 37. Therefore, advantageously a stress is hardly concentrated on the support 33, a life is lengthened, and a degree of design freedom increases. Further, the first curved portion and the second curved portion are continuously provided with the rigid coupling portion interposed therebetween, so that an elastic deformation amount can be designed in each of the first curved portion and the second curved portion. Therefore, the displacement amount of the movable contact portion is easily and accurately designed to obtain the connection terminal that can prevent the plastic deformation caused by an external load.

Preferably, the rigid coupling portion 36 is not necessarily an ideal rigid body, but the rigid coupling portion 36 only need to play a role considerable as a rigid body, without being deformed when the first curved portion 35 and the second curved portion 37 are elastically deformed.

In the first curved portion 35, a first extending portion 40*a* and a second extending portion 40*b* extend from the branch portion 34 so as to meander substantially in parallel with each other, and a curved slit 41 is formed between the first extending portion 40*a* and the second extending portion 40*b*.

In the second curved portion 37, a first extending portion 42*a* and a second extending portion 42*b* extend from the abutment-receiving portion 36 so as to meander substantially in parallel with each other, and a curved slit 43 is formed between the first extending portion 42*a* and the second extending portion 42*b*.

In the second curved portion 37, a portion located in an outside surface of a free end portion is used as a thick movable contact portion 38, and an abutment portion 39 extends to an inside from an inside surface of the free end portion. The abutment portion 39 can abut on the abutment-receiving portion 36 of the rigid coupling portion. Accordingly due this configuration, even if an overload is applied to the movable contact portion, the movable contact portion abuts on the rigid coupling portion to prevent the plastic deformation, and the connection terminal that can withstand the large load may be obtained.

In the present embodiment, each of the first and second extending portions 40*a*, 40*b*, 42*a*, and 42*b* does not have an equal width, but the width of the curved portion located on the outside is made larger than the width of the curved portion located on the inside. For this reason, advantageously the stress concentration is further hardly generated during an operation, and a life is lengthened. Further, the width of the slits 41 and 43 of the present embodiment are not necessarily equal, but the widths may of course vary as needed basis.

Figure 4A:
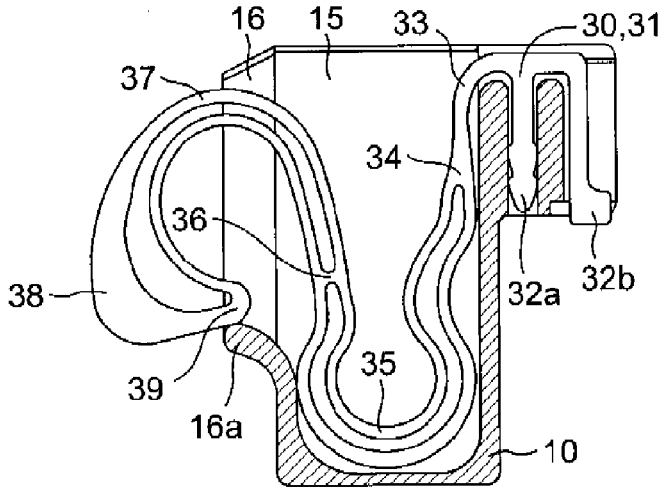
FIG. 4A is a sectional view illustrating the connector, as shown in FIGS. 1A, 1B and 1C, in which the connection terminal of the first embodiment is incorporated before an operation.
Figure 4B:
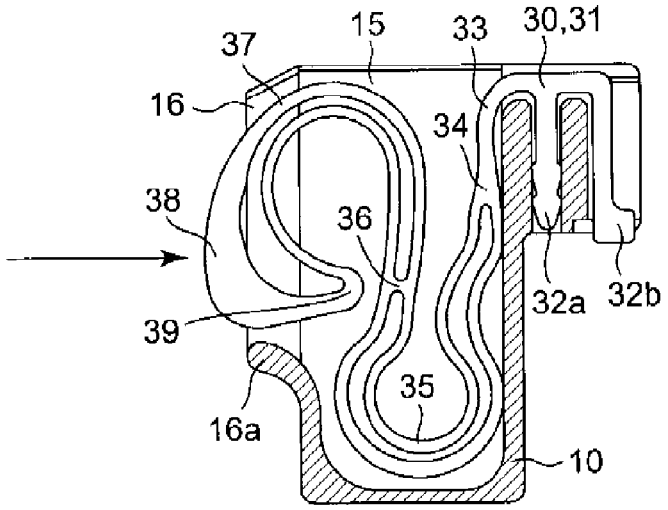
FIG. 4B is a sectional view illustrating the connector, as shown in FIGS. 1A, 1B and 1C, in which the connection terminal of the first embodiment is incorporated during an operation.

As illustrated in FIGS. 4A, 4B and 4B, the connection terminal 30 is inserted from above in the second storage space 15 of the housing 10. The press-fitting latching pawl 32*a* of the fixed portion 31 is press-fitted in and latched in the press-fitting latch hole 17. Therefore, the abutment portion 39 of the second curved portion 37 abuts on a positioning portion 16*a* provided in the lower inner peripheral edge portion of the contact hole 16 in the housing 10 to establish the positioning (FIG. 4A).

The fixing metal fitting 20 is inserted in the first storage space 12 of the housing 10, and the latching pawl 21 of the fixing metal fitting 20 is press-fitted in and fixed to the press-fitting hole 13 of the housing 10 (FIG. 1C).

The method for fixing the housing 10 to the connection terminal 30 or the fixing metal fitting 20 is not limited to the press fitting, but other methods for fixing such as adhesion and nipping may be adopted.

According to above configuration, advantageously the movable contact portion is accurately positioned, and the connector in which variation in an operating characteristic is small can be obtained.

According to the present embodiment, as illustrated in FIGS. 1C and 5A, the lower end face of the positioning protrusion 14 provided in the bottom surface of the bulging-out portion 11 is flush with the lower end face of the positioning support 22 of the fixing metal fitting 20 and the lower end face of the terminal portion 32*b* of the connection terminal 30. Therefore, when the connector of the present embodiment is assembled in the substantial U-shape notch provided in the edge portion of the printed board (not illustrated) to insert the latching pawl 21 of the fixing metal fitting 20 in a positioning through-hole made in the printed board, advantageously the connector can be assembled in the printed board with no rattle.

Figure 4C:
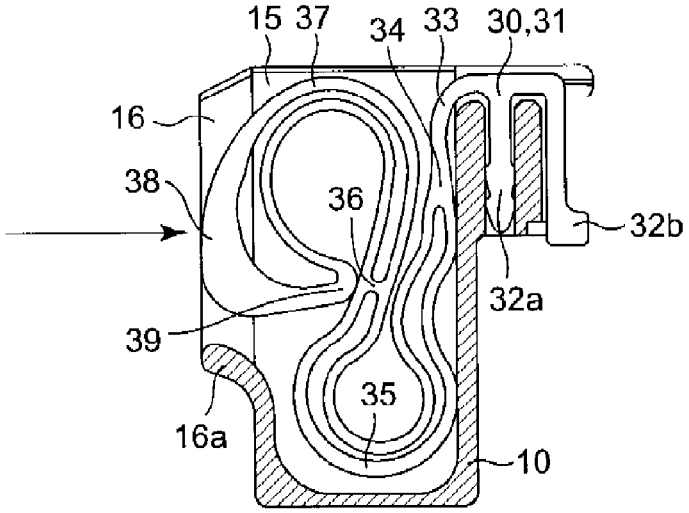
FIG. 4C is a sectional view illustrating the connector, as shown in FIGS. 1A, 1B and 1C, in which the connection terminal of the first embodiment is incorporated after an operation.

As illustrated in FIG. 4B, when an external force is applied to the movable contact portion 38 of the connection terminal 30, at first the second curved portion 37 is curved inward, the abutment portion 39 moves inward toward the abutment-receiving portion 36, and the second curved portion 37 is elastically deformed inward. When the movable contact portion 38 is further pushed, as illustrated in FIG. 4C, the abutment portion 39 abuts on the abutment-receiving portion 36 to regulate the elastic deformation of the second curved portion 37 wherein the rigidity is larger than that of the first curved portion 35 and the second curved portion 37, and hence the first curved portion 35 is largely elastically deformed. Due to this configuration, the stress concentration on the second curved portion 37 can be relaxed to effectively prevent the generation of the plastic deformation.

When the load on the movable contact portion 38 is removed, the connection terminal 30 can be returned to an initial position in FIG. 4A. That is, the shape of the abutment portion 39 is defined such that the abutment portion 39 abuts on the abutment-receiving portion 36 within a range in which the connection terminal 30 can elastically be deformed.

In the present embodiment, the description has been made on the configuration, in which the abutment portion 39 abuts on the abutment-receiving portion 36 of the rigid coupling portion. However, the abutting position of abutment portion 39 may be anywhere in a region where the first curved portion 35 and the second curved portion 37 are continuously coupled.

According to the present embodiment, the first curved portion 35 and second curved portion 37 are provided between the movable contact portion 38 and the fixed portion 31 while the abutment-receiving portion 36 is interposed between the first curved portion 35 and second curved portion 37, and a spring length is long. Therefore, the stress concentration is hardly generated while the desired displacement amount is ensured. For this reason, the long-life connector may be obtained wherein plastic deformation is hardly generated.

Figure 7A:
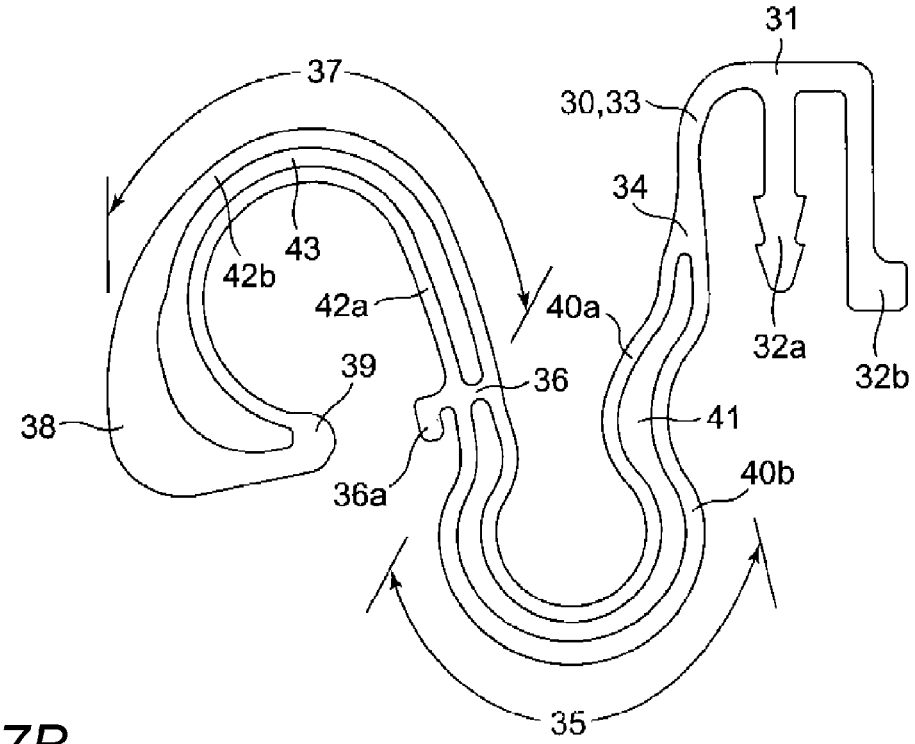
FIG. 7A is front view illustrating connection terminal in accordance with a second embodiment of the present invention.

As illustrated in FIG. 7A, a connector according to a second embodiment is substantially identical to the connector of the first embodiment. Further, the connector of the second embodiment differs from the connector of the first embodiment in that a substantial L-shape abutting protrusion 36*a* that can abut on the abutment portion 39 protrudes from the inside surface of the abutment-receiving portion 36. Because other configurations are identical to those of the first embodiment, the identical component is designated by the identical numeral, and the description thereof is omitted.

According to the present embodiment, because the substantial L-shape abutting protrusion 36*a* protrudes from the abutment-receiving portion 36, advantageously the abutting protrusion 36*a* can absorb and relax an impact force of the abutment portion 39 to prevent the plastic deformation of the connection terminal 30.

Figure 7B:
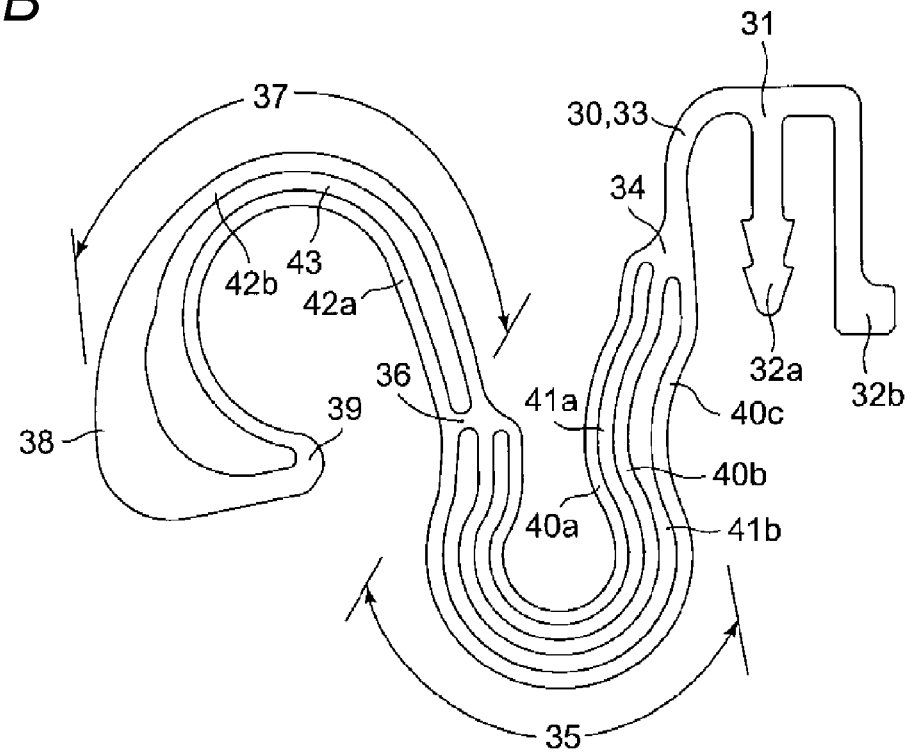
FIG. 7B is front view illustrating connection terminal in accordance with a third embodiment of the present invention.

As illustrated in FIG. 7B, a connector according to a third embodiment is substantially identical to the connector of the first embodiment. Further, the connector of the third embodiment differs from the connector of the first embodiment in that the first extending portion 40*a*, the second extending portion 40*b*, and a third extending portion 40*c* extend from the branch portion 34 so as to substantially meander in parallel with one another, thereby forming curved slits 41*a* and 41*b*. The abutment portion 39 can abut on the abutment-receiving portion 36 of the rigid coupling portion. Because other configurations are identical to those of the first embodiment, the identical component is designated by the identical numeral, and the description thereof is omitted.

According to the present embodiment, the first curved portion 35 is constructed by the first, second, and third extending portions 40*a*, 40*b*, and 40*c*. Therefore, advantageously the second curved portion 37 can be supported with a larger support force, and the plastic deformation of the second curved portion 37 can be prevented.

Figure 8A:
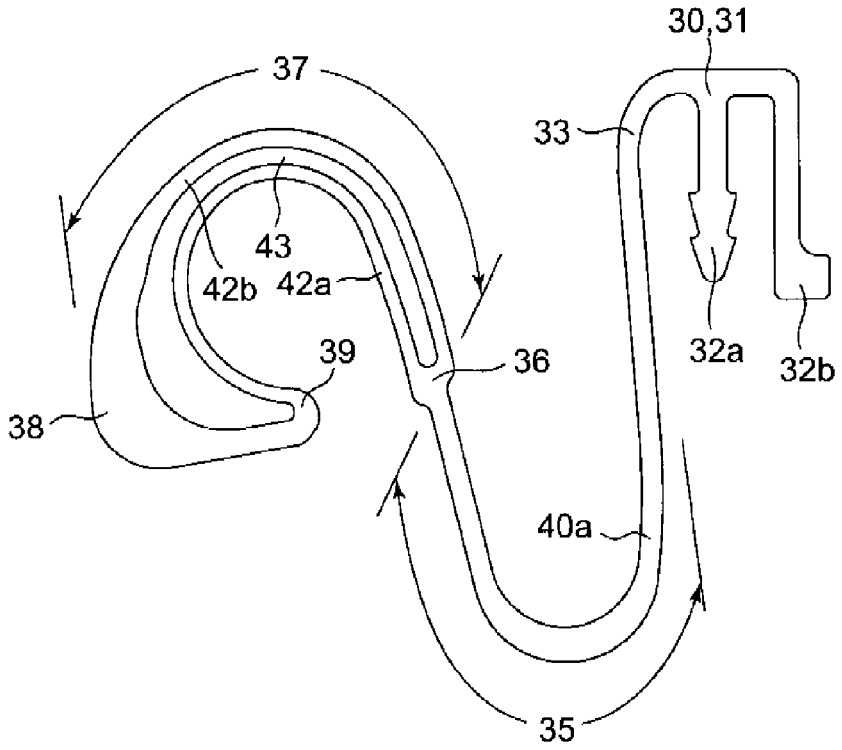
FIG. 8A is front view illustrating connection terminal in accordance with a fourth embodiment of the present invention.

As illustrated in FIG. 8A, a connector according to a fourth embodiment is substantially identical to the connector of the first embodiment. Further the connector of the fourth embodiment differs from the connector of the first embodiment in that the first curved portion 35 is constructed by the one extending portion 40*a*. Because other configurations are identical to those of the first embodiment, the identical component is designated by the identical numeral, and the description thereof is omitted.

According to the present embodiment, advantageously the shape of the first curved portion 35 is simplified and a metallic mold can be produced easily.

Figure 8B:
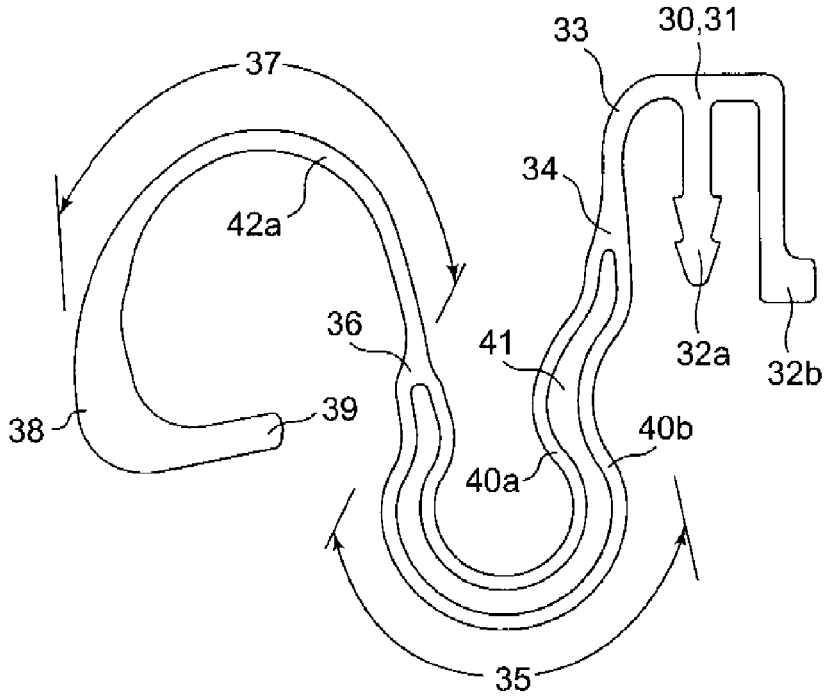
FIG. 8B is front view illustrating connection terminal in accordance with a fifth embodiment of the present invention.

As illustrated in FIG. 8B, a connector according to a fifth embodiment is substantially identical to the connector of the first embodiment. Further the connector of the fifth embodiment differs from the connector of the first embodiment in that the second curved portion 37 is constructed by the one extending portion 42*a*. Because other configurations are identical to those of the first embodiment, the identical component is designated by the identical numeral, and the description thereof is omitted.

According to the present embodiment, advantageously the shape of the second curved portion 37 is simplified and a metallic mold can be produced easily.

Figure 9A:
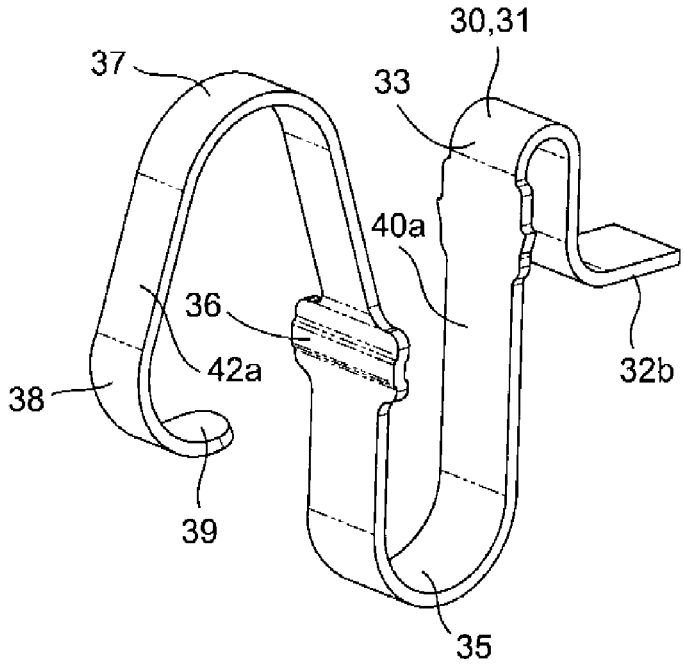
FIG. 9A is a perspective view illustrating a connection terminal in accordance with a sixth embodiment of the present invention.
Figure 9B:
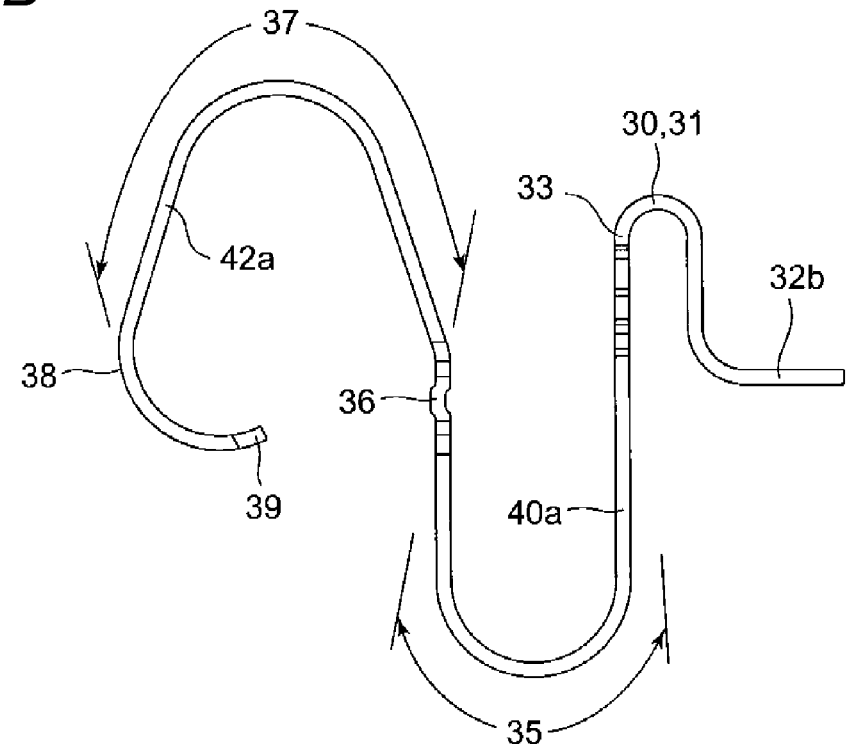
FIG. 9B is a front view illustrating a connection terminal in accordance with the sixth embodiment of the present invention.

In a connector according to a sixth embodiment, as illustrated in FIGS. 9A and 9B, a substantial-L-shape terminal portion 32*b* that can be press-fitted in the housing extends onto one side from the fixed portion 31. The first curved portion 35 extends from the fixed portion 31 while the support 33 provided on the other side is interposed between the first curved portion 35 and the fixed portion 31, and the second curved portion 37 extends from the first curved portion 35 with the abutment-receiving portion 36 interposed therebetween. Therefore, advantageously the stress is hardly concentrated on the fixed portion 31, the life is lengthened, and the degree of design freedom increases.

The first curved portion 35 is constructed by the first extending portion 40*a* extending from the support portion 33, and the second curved portion 37 is constructed by the first extending portion 42*a* extending from the abutment-receiving portion 36. In the second curved portion 37, a portion located in the outside surface of the free end portion is used as the movable contact portion 38, and a leading end extends inward to form the abutment portion 39. The abutment portion 39 can abut on the abutment-receiving portion 36. Particularly, the abutment-receiving portion 36 is widened and subjected to bending work, thereby enhancing the rigidity. Because other configurations are identical to those of the first embodiment, the identical component is designated by the identical numeral, and the description thereof is omitted.

According to the present embodiment, advantageously the connector can be produced by the press working to widen selection of the production method.

In the above embodiments, the description has been made on the case where the set of two connection terminals and the one connection terminal are combined in order to enhance connection reliability. Alternatively, the connector may be composed of only the one connection terminal, or only the set of two connection terminals. A set of three connection terminals may be incorporated, and the number of connection terminals can of course be selected as needed basis. The extending portion and the slit do not necessarily have the equal width, but the width may be changed as needed basis. For example, in the curved portion of the extending portion, only the width of the curved portion of the extending portion located on the outside is increased, and the generation of the stress concentration may be prevented to enhance durability.

In the embodiments, the description has been made on the case where the connection terminal is incorporated in the housing. Alternatively, the printed board itself may be used as the housing, and the connection terminal of the present application may directly be incorporated in the side end face thereof. Therefore, advantageously the conventional housing and fixing metal fitting are no longer needed, and consequently a whole device can further be downsized.

The connector in which the connection terminal of the present invention is incorporated is not limited to the shapes described above, but the connector may of course be formed into a shape that can be surface-mounted on an upper surface of the printed board.

There has thus been shown and described a connecting terminal and a connector which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A connection terminal comprising:

a movable contact portion protruding out of a contact hole of a housing of the connection terminal, and adapted to be pressed;

a first curved portion comprising a free end portion having a fixed portion;

a second curved portion comprising a free end portion having the movable contact portion;

a rigid coupling portion interposed between the first curved portion and the second curved portion, the rigid coupling portion being continuous with the first curved portion and the second curved portion and being directly coupled to the first curved portion and the second curved portion;

an abutment portion disposed on an opposite side to the second curved portion with respect to the movable contact portion, and adapted to be displaced toward the rigid coupling portion; and wherein the abutment portion is adapted to abut on the rigid coupling portion.

2. The connection terminal according to claim 1, wherein at least one of the first curved portion and the second curved portion, is formed by a plurality of curved extending portions, and a curved slit is provided between the curved extending portions.

3. A connector, comprising the movable contact portion of the connection terminal according to claim 2, the movable contact portion protrudes out of the contact hole of the housing of the connection terminal and is adapted to be pressed.

4. A connector, comprising the movable contact portion of the connection terminal according to claim 1, the movable contact portion protrudes out of the contact hole of the housing of the connection terminal and is adapted to be pressed.

5. The connector according to claim 4, wherein the housing comprises an inner peripheral edge portion, the edge portion having a positioning portion, such that the abutment portion abuts on the positioning portion.

6. The connection terminal according to claim 1, wherein the rigid coupling portion has a larger rigidity than the first curved portion and the second curved portion.

7. A connection terminal comprising:

a movable contact portion protruding out of a contact hole of a housing of the connection terminal, and adapted to be pressed;

a first curved portion comprising a free end portion having a fixed portion;

a second curved portion comprising a free end portion having the movable contact portion;

a rigid coupling portion interposed between the first curved portion and the second curved portion, the rigid coupling portion being continuous with the first curved portion and the second curved portion;

an abutment portion disposed on an opposite side to the second curved portion with respect to the movable contact portion, and adapted to be displaced toward the rigid coupling portion;

wherein at least one of the first curved portion and the second curved portion, is formed by a plurality of curved extending portions, and a curved slit is provided between the curved extending portions; and wherein the abutment portion is adapted to abut on the rigid coupling portion.

8. The connection terminal according to claim 7, further comprising an abutting protrusion that protrudes from an outward surface of the rigid coupling portion and is adapted to abut on the abutment portion.

9. A connector, comprising the movable contact portion of the connection terminal according to claim 8, the movable contact portion protrudes out of the contact hole of the housing of the connection terminal and is adapted to be pressed.

10. A connector, comprising the movable contact portion of the connection terminal according to claim 7, the movable contact portion protrudes out of the contact hole of the housing of the connection terminal and is adapted to be pressed.

11. A connection terminal comprising:

a movable contact portion protruding out of a contact hole of a housing of the connection terminal, and adapted to be pressed;

a first curved portion continuously formed, the first curved portion comprising a free end portion having a fixed portion;

a second curved portion continuously formed, the second curved portion comprising a free end portion having the movable contact portion;

a rigid coupling portion interposed between the first curved portion and the second curved portion;

an abutment portion disposed on an opposite side to the second curved portion with respect to the movable contact portion, and adapted to be displaced toward the rigid coupling portion; and wherein the abutment portion is adapted to abut on the rigid coupling portion.

12. The connection terminal according to claim 11, further comprising an abutting protrusion that protrudes from an outward surface of the rigid coupling portion and is adapted to abut on the abutment portion.

13. A connector, comprising the movable contact portion of the connection terminal according to claim 12, the movable contact portion protrudes out of the contact hole of the housing of the connection terminal and is adapted to be pressed.

14. A connector, comprising the movable contact portion of the connection terminal according to claim 11, the movable contact portion protrudes out of the contact hole of the housing of the connection terminal and is adapted to be pressed.

15. A connection terminal comprising:

a movable contact portion protruding out of a contact hole of a housing of the connection terminal, and adapted to be pressed;

a first curved portion comprising a free end portion having a fixed portion;

a second curved portion comprising a free end portion having the movable contact portion;

a rigid coupling portion interposed between the first curved portion and the second curved portion, the rigid coupling portion being continuous with the first curved portion and the second curved portion;

an abutment portion disposed on an opposite side to the second curved portion with respect to the movable contact portion, and adapted to be displaced toward the rigid coupling portion;

wherein at least one of the first curved portion and the second curved portion, is formed by a plurality of curved extending portions, and a curved slit is provided between the curved extending portions; and further comprising an abutting protrusion that protrudes from an outward surface of the rigid coupling portion and is adapted to abut on the abutment portion.

16. A connector, comprising the movable contact portion of the connection terminal according to claim 15, the movable contact portion protrudes out of the contact hole of the housing of the connection terminal and is adapted to be pressed.

17. A connection terminal comprising:

a movable contact portion protruding out of a contact hole of a housing of the connection terminal, and adapted to be pressed;

a first curved portion continuously formed, the first curved portion comprising a free end portion having a fixed portion;

a second curved portion continuously formed, the second curved portion comprising a free end portion having the movable contact portion;

a rigid coupling portion interposed between the first curved portion and the second curved portion;

an abutment portion disposed on an opposite side to the second curved portion with respect to the movable contact portion, and adapted to be displaced toward the rigid coupling portion; and further comprising an abutting protrusion that protrudes from an outward surface of the rigid coupling portion and is adapted to abut on the abutment portion.

18. A connector, comprising the movable contact portion of the connection terminal according to claim 17, the movable contact portion protrudes out of the contact hole of the housing of the connection terminal and is adapted to be pressed.

19. A connection terminal comprising:

a movable contact portion protruding out of a contact hole of a housing of the connection terminal, and adapted to be pressed;

a first curved portion comprising a free end portion having a fixed portion;

a second curved portion comprising a free end portion having the movable contact portion;

a rigid coupling portion interposed between the first curved portion and the second curved portion, the rigid coupling portion being continuous with the first curved portion and the second curved portion;

an abutment portion disposed on an opposite side to the second curved portion with respect to the movable contact portion, and adapted to be displaced toward the rigid coupling portion;

wherein in a relaxed state of the connection terminal:

the rigid coupling portion forms a first continuous loop connection with the first curved portion and the free portion of the first curved portion; and the rigid coupling portion forms a second continuous loop connection with the second curved portion and the free end of the second curved portion; and wherein the abutment portion is adapted to abut on the rigid coupling portion.

* * * * *